United States Patent [19]

Bustos

[11] Patent Number: 4,872,567

[45] Date of Patent: Oct. 10, 1989

[54] SHELF CONVERSION UNIT FOR GONDOLA DISPLAY

[75] Inventor: Rafael T. Bustos, Alpharetta, Ga.

[73] Assignee: Leggett & Platt, Incorporated, Carthage, Mo.

[21] Appl. No.: 110,380

[22] Filed: Oct. 20, 1987

Related U.S. Application Data

[63] Continuation of Ser. No. 866,776, May 23, 1986, abandoned.

[51] Int. Cl.[4] ..... A47F 7/00

[52] U.S. Cl. ..... 211/59.2; 211/90; 211/175; 248/241; 248/247; 29/401.1

[58] Field of Search ..... 211/59.2, 187, 90, 186, 211/190, 175; 248/243, 247, 241; 29/401.1, 526.1

[56] References Cited

U.S. PATENT DOCUMENTS

| | | | |
|---|---|---|---|
| 1,577,066 | 3/1926 | Medart et al. . | |
| 2,528,358 | 10/1950 | Grass . | |
| 2,891,678 | 6/1959 | Levy . | |
| 3,130,693 | 4/1964 | Shell . | |
| 3,285,208 | 11/1966 | Cohen . | |
| 3,527,353 | 9/1970 | Farren . | |
| 3,627,247 | 12/1971 | Krikorian . | |
| 3,631,821 | 1/1972 | Zacharion . | |
| 3,640,389 | 2/1972 | Snyder . | |
| 3,667,826 | 6/1972 | Wood et al. . | |
| 4,146,140 | 3/1979 | Suter et al. . | |
| 4,151,917 | 5/1979 | Pugh . | |
| 4,154,419 | 5/1979 | Breidenbach . | |
| 4,204,480 | 5/1980 | Hanna . | |
| 4,421,239 | 12/1983 | Vargo . | |
| 4,513,669 | 4/1985 | Steinke . | |
| 4,519,508 | 5/1985 | Gullett et al. | 211/187 X |
| 4,592,286 | 6/1986 | Trubiano . | |

*Primary Examiner*—Blair M. Johnson

*Attorney, Agent, or Firm*—Wood, Herron & Evans

[57] ABSTRACT

A shelf coverting unit for a gondola display rack which is capable of converting from one form of shelving to another the gondola display racks of a number of different manufacturers or of a number of different designs. The racks have multiple uprights, each with a plurality of spaced slots on which shelves or shelf supporting brackets may be fastened to support the shelves at different heights. The unit includes a replacement shelf having in its rear panel a plurality of pairs of vertically spaced, horizontally elongated slotted openings. The shelf is supported on the uprights with separate brackets having forward and upwardly facing hooks which slideablyu engage the slotted openings to accommodate differences in upright spacing, and having rearwardly and downwardly facing hooks which engage the uprights. The brackets are oppositely offset and interchangeable to increase the range of upright spacings which they will accommodate.

9 Claims, 3 Drawing Sheets

SHELF CONVERSION UNIT FOR GONDOLA DISPLAY

This is a continuation of application Ser. No. 866,766 filed May 23, 1986, now abandoned.

The present invention relates to gondola style display racks of the type used in supermarkets and other retail stores to display and dispense products. More particularly, this invention relates to replacement shelf units for gondola displays, and more specifically, to a novel replacement shelf unit which is useful in converting to a different type of display gondola displays of a number of the different designs or of a number of different manufacturers.

In the display of items of merchandise in supermarkets and other retail stores use has been increasingly made of what has become known in the trade as the gondola style display rack. The rack is characterized by a standard which is either floor mounted or wall mounted and which is provided with uprights on which shelving can be attached and supported at various heights. So that the shelves can be removeably attached at different heights, the uprights have in them a series of slots or other means vertically spaced along the uprights to which the shelves can be attached. The shelves are supported on the uprights of gondola displays with either shelf brackets or with other structures formed integrally with the shelves. The gondola displays provide advantages over built-in shelving, custom display cases, and other structures having more specialized application in that they are flexible and adaptable to various shelf heights and shelf spacing.

One of the limitations of the gondola display racks currently in use is that only the shelves originally supplied with the display rack assembly or those made by the same manufacturer tend to fit the uprights of any given rack. Therefore, the ability to change the shelf design is limited to those designs anticipated and provided for by the original manufacturer. The necessity to change shelf design is frequently brought about by changes in the lines of products being sold by the merchant, by changes in the shape and configuration of the packaging of the products, by changes in the marketing techniques for display and dispensing of the products, or by changes in the floor plan of the merchant. Such changes may call for a change in the size or configuration of the shelf, or for some other change in the shelf type.

For example, there is currently a recognition that so-called "gravity-feed" shelves have more desirable utility in some applications former served with conventional horizontal shelving. Gravity-feed shelving is particularly useful with products which will, by the very shape of their packaging or of the objects themselves, roll or slide to a desired position on the shelf when the shelf is inclined in a particular direction, usually toward the front or toward the front and one side. An advantage of gravity-feed shelving is that with it the product is constantly presented to the front edge of the display assembly where it is readily visible to the customer and can be readily removed. When one item is removed, another moves by gravity to take its place in the optimal position on the rack. Such a use of gravity-feed shelving facilitates the locating of merchandise by the customer, increases the volume of merchandise being sold by a more effective display of the merchandise, and reduces the labor involved in arranging the products on the shelf for display.

The majority of the gondola display racks in use are equipped with conventional horizontal shelves adjustably mounted to the supports. The hardware for attaching the shelves to the supports is usually so specific in design that the shelves will not fit upon the supports of another manufacturer. As a consequence, a change in shelf design is limited to the replacement shelving of the types made available by the same manufacturer which built the original gondola display rack assembly purchased by the merchant. Accordingly, the option to convert a conventional horizontal shelf gondola display to one of the gravity-feed type may not be available. The manufacture of special purpose gravity-feed shelving specially configured to fit the racks of a specific manufacturer is inefficient and less economical than shelving which could be marketed for use on racks of many different designs.

It is an objective of the present invention to provide a gondola display converting unit in which a replacement shelf of a single design can be supported on a number of display racks of a number of different designs or made by a number of different manufacturers. It is a particular objective of the present invention to provide a conversion shelf unit for a gondola display which is useful in converting the displays of any one of the number of different gondola manufacturers to a different type of display. More particularly, it is an object of the present invention to provide a replacement shelf for a gondola display assembly which is useful in converting a horizontal shelf gondola display assembly of any one of a number of different designs of any one of a number of different manufacturers to a gravity-feed gondola display.

Gondola display racks have typically been provided with supports having a plurality of uprights, usually two. These uprights have in them a series of vertically spaced slots adapted to receive some sort of a tab or hook used to selectively attach the various shelves at any one of a number of selected heights. Different designs and models of display racks differ, particularly those of different manufacturers, and accordingly, the spacing between the vertical rows of slots presented by the uprights, the configuration or shape of the slots, the vertical spacing of the slots on the uprights, and the dimensions of the slots may differ from design to design. As a result, shelving of one manufacturer is provided with attachment means specific to that manufacturer's designed racks, and accordingly, is incapable of rendering the shelves attachable to the racks of other manufacturers or even to racks of a different model or design by the same manufacturer.

Accordingly, it is an objective of the present invention to provide a gondola display shelf converting unit for converting the display assemblies of any one of a number of different designs of any one of a number of different manufacturers to a gondola display of different type. More particularly, it is an objective of the present invention to provide replacement shelves for gondola display assemblies which are capable of use on different gondola display designs of different manufacturers in which the designs differ in either the horizontal spacing of the vertical uprights, the vertical spacing of the slots on those vertical uprights, or the dimensions and configurations of the slots in the uprights.

It has been found that, in achieving the objectives of the present invention, the provision of means for engaging a particular hole in the uprights of the displays of different manufacturers is achievable by providing hooks or tabs of shapes and sizes selected to engage the holes of the racks of differing designs. However, the proper alignment of a plurality of tabs necessary to support the shelf on the rack of a given manufacturer restricts the ability of these tabs to align with the hole patterns and spacings on the racks of another manufacturer.

The present invention provides a shelf converting unit which includes a replacement shelf and a plurality of separate brackets, usually two in number, which are used to hang the shelves on the uprights. The brackets each include at least one hook and preferably an additional hook, tab, or other guide means for hanging the bracket on an upright of the display rack of any one of a number of different gondola display manufacturers. The bracket is further provided with a pair of forwardly and upwardly facing hooks on which the shelf itself will hang. In practice, the use of a plurality of brackets will present at least four hooks in vertically aligned pairs upon which the shelf will be hung. The location of these hooks, however, will differ depending upon the design of the support. In order to accommodate the variations experienced by supports of different designs, the shelf is provided with horizontally extended slotted openings which will receive the upwardly facing hooks of the brackets over a wide range of spacings.

In one embodiment of the invention, the horizontally extended slotted openings are each defined by a single widened slot in the rear of the shelf which will allow the hooks of the bracket to slidably engage the shelf to accommodate variations in the spacing of the brackets as determined by the spacing of the uprights on the support. In another embodiment of the invention, the rear of the shelf is provided with a series of horizontally spaced slots, any one of which may engage the bracket to support the shelf in alignment with the spacings determined by the geometry of the support.

It is a further contribution of the present invention to provide a bracket design whereby the shelf supporting hooks of the bracket and the hooks engageable with the uprights are offset from each other in such a way that the spacing of the hook receiving openings of the shelf may differ from the spacing of hook receiving slots in the vertical uprights. As a result, exchange of a bracket of either right or left offset with a bracket of the opposite offset will change the upright spacing tolerated by the replacement shelf. Specifically, the provision of brackets oppositely offset to support a given shelf upon two uprights can, by exchange of the brackets provided, according to the principles of the present invention, be made to accommodate uprights at different spacings for each position of engagement between the brackets and the shelf.

Furthermore, by provision of the offset bracket provided according to the principles of the present invention, the horizontal slotted opening can be extended across a major portion of the width of the shelf by a series of slots which is less likely to weaken the structural strength of the rear portion of the shelf than a single excessively wide slot. With this configuration, the material separating the slots of the series, if narrow, can be made to present a slot in the shelf in alignment with a bracket of either one offset or another for uprights of any spacing within a wide range of upright spacings.

The invention further provides enhancement of the flexibility in the use of the replacement shelf described by provision of additional pairs of rows of openings in the rear of the shelf to allow for the mounting of the replacement shelf at a plurality of heights on the rack given any specific selected level for mounting of the brackets on the uprights.

These and other objectives and advantages of the present invention will be more readily apparent from the following detailed description of the drawings illustrating the preferred forms of the present invention in connection with a shelf conversion unit for converting conventional, horizontal shelf gondola displays to gondola displays of the gravity-feed shelf type.

FIG. 1 a gondola display rack employing a replacement shelf of the gravity-feed type according to the principles of the present invention, with a portion of the replacement shelf and rack support cut away to illustrate the interrelation of the supporting bracket with the replacement shelf and with the uprights of the display rack.

Figure 1:
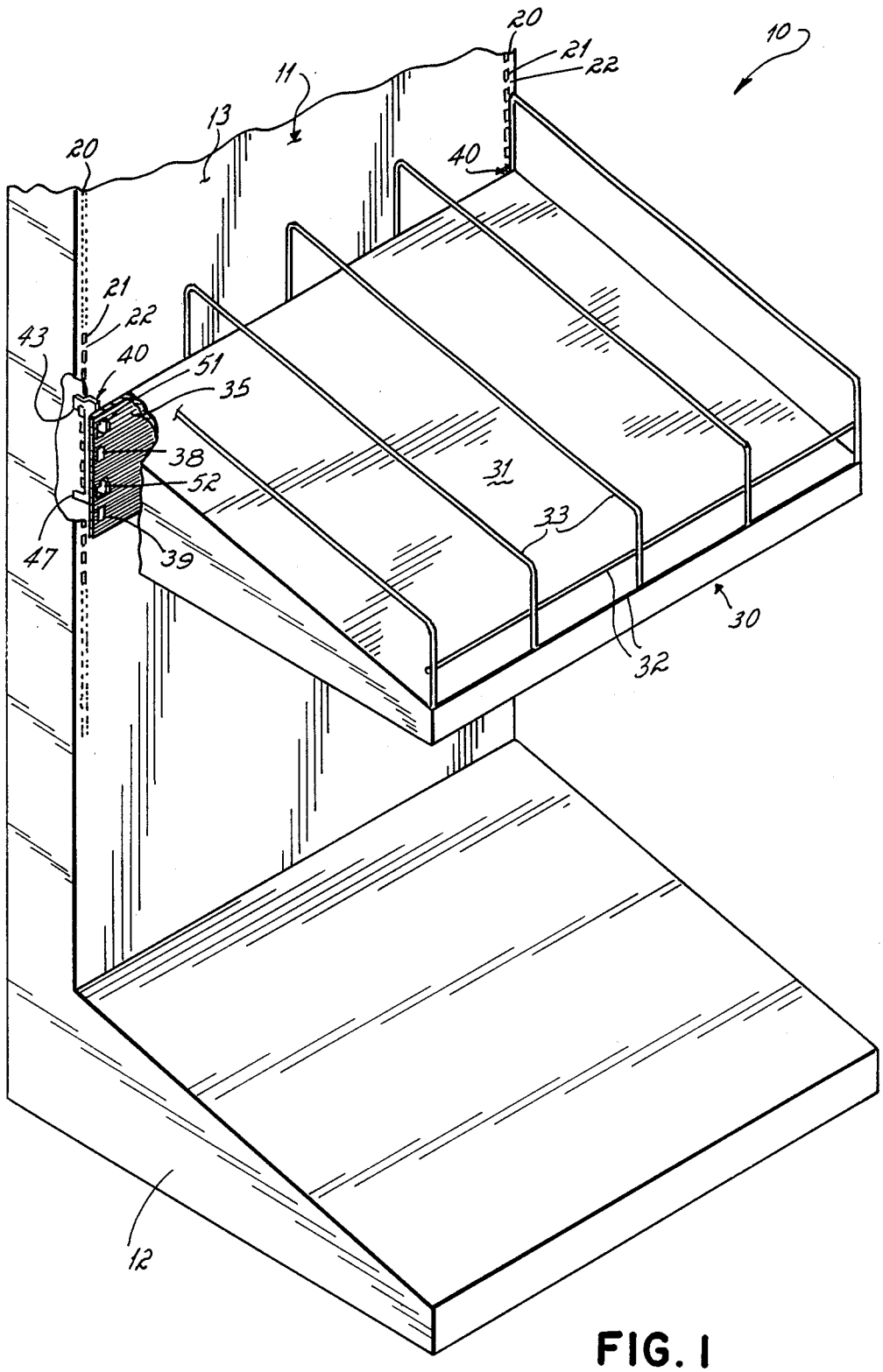

Referring to FIG. 1, a gondola display rack 10 is shown. The rack 10 includes a vertical support stand 11 of the floor mounted type. The stand includes a base 12 which rests upon the floor of a merchandising establishment. To the base 12 is rigidly attached an upstanding vertical back 13. Often, the back 13, rather than being attached to a floor mounted support 12, is attached to or part of the wall construction of the building. Formed in the support 13 are a plurality of uprights 20. In this case, the number of such uprights is two. While in the embodiment shown, the uprights are formed in the vertical support 13, it is also common that uprights are provided in the form of separate vertical standards secured to the support 13 or alternatively, to a wall.

The gondola display includes a replacement shelf 30. In the preferred embodiment, the shelf 30 is a gravity-feed shelf, but it could as well be a horizontal shelf. The shelf 30 is provided with a downwardly and outwardly sloping upper surface 31 on which merchandise, such as beverage cans, are placed so as to slide forward to a stop at the front edge 32 of the shelf 30. In this way, the cans will feed one by one to the stop at the front edge 32 as they are individually removed by a customer. The shelf 30 includes a plurality of guides or partitions 33 which serve to separate rows of merchandise and guide it in an orderly path toward the front of the rack. The shelf 30 is attached and supported on the uprights 20 by pair of brackets 40. The design of the brackets 40 in their relation to the shelf 30 and uprights 20 can be better understood by reference to FIGS. 2 through 6.

Figure 2:
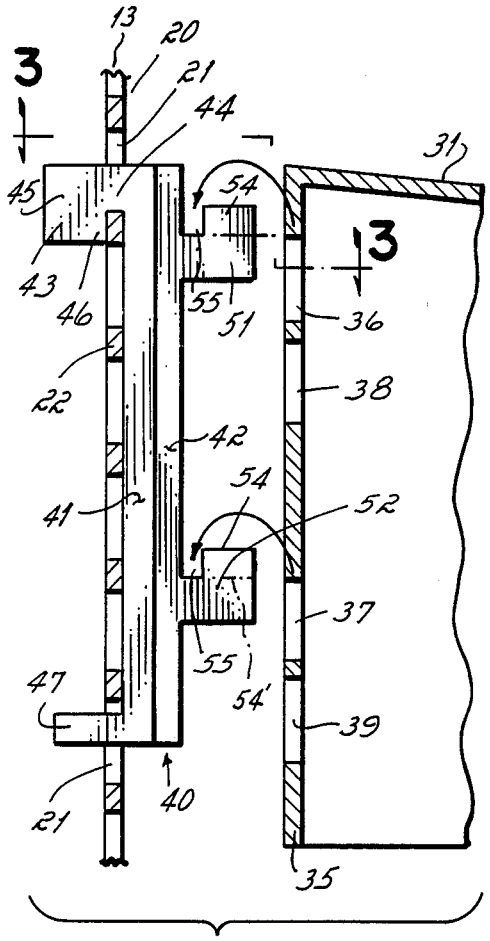
FIG. 2 is an exploded side view of the cutaway portion of FIG. 1 showing the shelf bracket according to principles of the present invention mounted to the upright of the display rack and showing the relationship of replacement shelf to the supporting bracket.

Referring to FIG. 2, one of the vertical uprights 20 is shown in section. The upright includes a plurality of vertically spaced, vertical slots 21, each evenly spaced on the uprights 20 and differentiated from the adjacent slots by the web portion 22.

In FIG. 2, the shelf 30 is shown detached from the upright 20 of the vertical support 13. The shelf 30 is shown in section and includes the upper sloped, gravity-feed product supporting surface 31 and the rear vertical rear surface 35 formed integrally of the same sheet material as the upper surface 31. The rear surface 35 lies in a vertical plane parallel to the plane of the uprights 20. The rear surface 35 may be reinforced by a sheet metal gusset member (not shown) overlying the rear surface and having openings formed therein which match the openings in the rear surface 35.

In the rear supporting surface 35 of the shelf 30 are alternative pairs of vertically spaced slotted openings. The uppermost pair of openings includes an upper opening 36 and a lower opening 37 which are adapted to hang the shelf 30 on hooks of a support bracket 40 in a manner described below. In order to multiply the number of height positions available for mounting the shelf 30 on the uprights 20, there is provided the additional or second pair of slotted openings each vertically spaced from the upper pair 36, 37, and in this case, below them. The second pair of openings includes an upper opening 38 and a lower opening 39, on which the shelf 30 may be alternatively mounted to the bracket 40. Each of the pair of openings 36, 37 and 38, 39 has at least one identical pair of openings (not shown) spaced horizontally therefrom in the shelf rear surface 35 for engagement by another one of the brackets 40 so that the shelf 30 is supported at more than one point by attachment to more than one upright.

The bracket 40 is made of a single piece of metal integrally formed into a rearwardly projecting portion 41 and a forwardly projecting portion 42. The rearwardly projecting portion 41 includes an upper rearwardly and downwardly extending hook 43. This hook is adapted to fit into any one of the slots 21 in an upright of any one of a number of different manufacturers, as will be further explained below. The hook includes a neck portion 44 and a head portion 45. The hook 44 is dimensioned to extend through the slot of an upright and long enough to accommodate the thicknesses normally encountered in the material from which the uprights are formed so that the head portion 45 of the hook locks on the upright. The head portion 45 is sufficiently limited in height so as to clear the vertical extent of the slot 21 in uprights of various manufacturers. The head 45 includes a downwardly extending tip 46 which is at right angles to the neck 44 and sufficiently long to engage the web portion 22 of the upright 20 and to hold the shelf to the upright to support loads encountered when products are displayed on the shelf 30.

The rearwardly projecting portion 41 of the bracket 40 also includes a guide pin or tab 47 at the lower end of the bracket 40. The guide pin 47 is dimensioned so as to provide sufficient strength to prevent the bracket 40 from torqueing off of the upright 20, but it is sufficiently small to accommodate as many upright configurations as possible. The guide pin 47 may also be in the form of a hook (not shown) which will increase the structural utility of the bracket but will decrease the flexibility of the bracket in adapting to various upright configurations. On the other hand, employing multiple brackets wherein the guide pin 47 is spaced at different distances from the hook 43 will allow accommodation of a wider variety of hole spacings in the uprights. Alternatively, a movable pin in place of the guide pin 47 could be utilized (not shown) to provide increased utility and flexibility, but at probable increased cost.

The forwardly projecting portion 42 of the bracket 40 is provided with a pair of forwardly and upwardly extending hooks, including an upper hook 51 and a lower hook 52. The hooks 51 and 52 are vertically spaced at the same distance as the pairs of slotted openings 36, 37 and 38, 39 in the back 35 of the shelf 30. The hooks 51 and 52 each include a head portion 54, which is slightly narrower than the height of the openings 36 through 39 so as to be insertable therein, and a neck portion 55 sufficiently long to extend through the thickness of the rear 35 of the shelf 30 so that the upper edge of the openings 36 through 39 in the rear 35 of the shelf 30 will snap securely over and into the notch formed between the head 54 and the body of the forwardly extending portion 42 of the bracket 40. Alternatively, and in the preferred embodiment of the invention, the head 54 is omitted from the lower hook 52, as indicated by the phantom line 54'. The lower hook 52 then is rectangular in configuration, rather than hook shaped.

Figure 4:
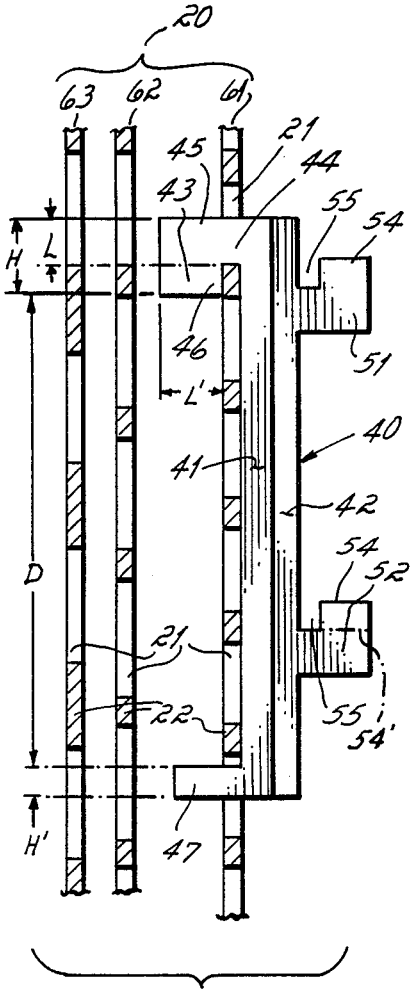
FIG. 4 is a side view of the upright and bracket shown left portion of the drawing of FIG. 2 showing the support bracket in relation to the hole patterns presented by the slots in the vertical uprights of gondola display assemblies of different manufacturers.

Referring to FIG. 4, the upright 20 is shown in three configurations which are expected to be encountered among designs of various manufacturers. These are shown as variations 61, 62 and 63. As FIG. 4 illustrates, the vertical spacings of the slots 21 in the various configurations of uprights 61, 62, and 63 differ. While it is not shown, the widths and shapes of the slots or holes in the uprights 20 also may vary from manufacturer to manufacturer. Accordingly, the shape of the tab 43 and guide pin 47 are of uniform, rectangular cross section so as to accommodate the greatest variety of expected configurations of uprights. While the dimensions vary from one application to another, preferred dimensions for one embodiment of the rearwardly extending portion 41 of the bracket 40 are as follows: The thickness T of the material of the rearwardly extending portion 41 is uniform at one-eighth inches, the length L of the neck 44 of the upper hook 43 in the embodiment shown is seven-sixteenths inches, the height H of the head 45 of the hook 43 is five-eighths inches, the length L' of the tab 46 of the head 45 is one-half inch, the distance D between the lower edge of the hook 43 and the upper edge of the guide pin 47 is four and one-fourth inches, and the height H' of the guide pin 47 is five-sixteenths inches.

Figure 3:
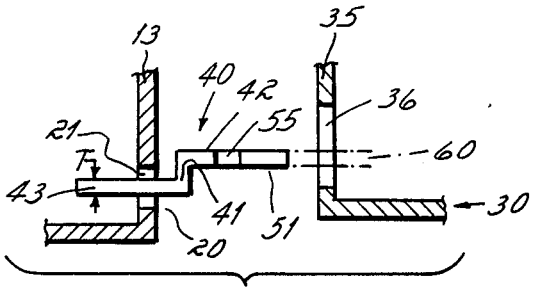
FIG. 3 is a cross-sectional view along 3-3 of FIG. 2 showing relationship of the offset bracket with the replacement shelf.

Referring to FIG. 3, from the top cross-sectional view, the offset of the bracket 40, according to the principles of one embodiment of the invention, is more completely shown. The Figure shows the upright 20 of the support 13 defined by the slots 21 into which the hook portion 43 of the bracket 40 is inserted. The hook portion 43 is part of the rearwardly projecting portion 41 of the bracket 40. This portion 41, as shown, is offset from the forwardly projecting portion 42 of the bracket 40. The forwardly projecting portion 42 of the bracket 40 is shown in alignment with a point 60 in the opening 36 which is formed in the rear 35 of the shelf 30. As shown, the opening 36, as are the other openings 37, 38, and 39 of FIG. 2, is a single, horizontally extended slot. As such, with different spacings of the uprights 20, the forwardly projecting hook 51 will align with a range of points within the transverse extent of the slot 36, thus accommodating a range of possible upright spacings.

Figure 5:
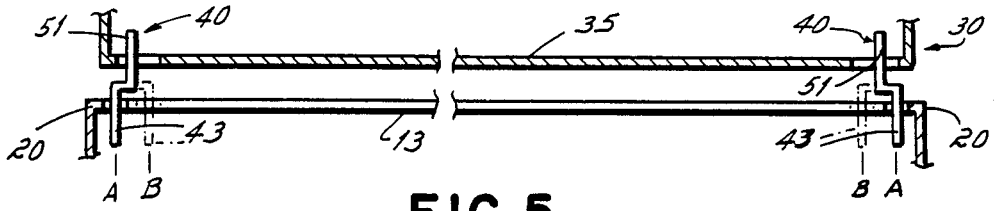
FIG. 5 is a cross-sectional top view similar to that of FIG. 3 showing the manner in which different spacings of the uprights can be accommodated by exchanging brackets of the opposite offset.

Referring to FIG. 5, the use of the offset brackets 40 to accommodate different spacings of the uprights 20 is better illustrated. FIG. 5 shows the uprights in positions A, which are the more widely spaced positions, and positions B, which are the more closely spaced positions. As shown, by interchanging the differently offset brackets 40, the differing bracket spacings of the A and B positions will allow accommodation of two upright spacings for each transverse position of the bracket along the opening in the shelf back.

Figure 6:
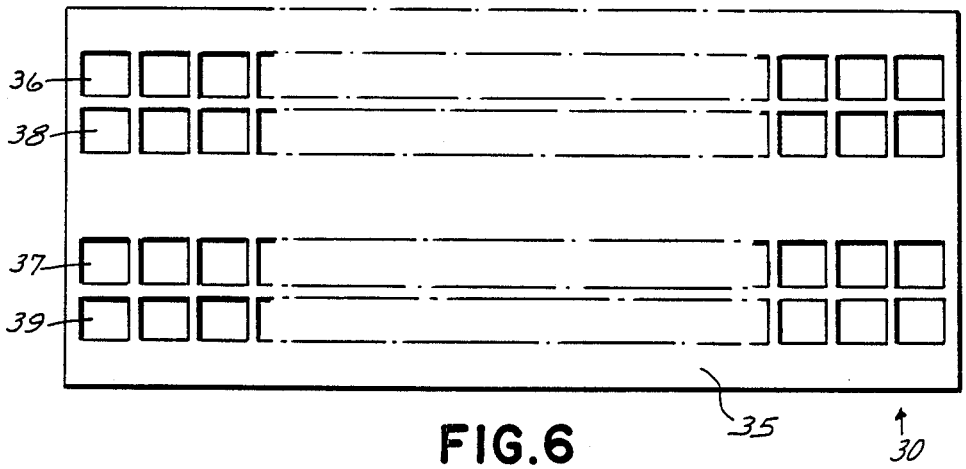
FIG. 6 is a rear view of the replacement shelf showing an embodiment of the invention in which the elongated openings are formed of a series of horizontally spaced slots.

Furthermore, FIG. 6 illustrates an alternative embodiment in which the slots 36 through 39 in the shelf 35 are elongated through the formation of a series of horizontally spaced slots along the back 35 of the shelf 30. In this way, a wide range of upright widths can be accommodated by the interrelation of the elongated slotted openings with the offset brackets 40.

The foregoing sets forth the preferred embodiments which incorporate the principles of the present invention. Having described the embodiments of the invention, what is claimed is the following:

I claim:

1. The method of converting the shelf of any one of a plurality of differing gondola displays to a fixed size and configuration replacement shelf of a different type and wherein each of the gondola displays has a base and at least two horizontally spaced vertical uprights fixed to and extending upwardly from said base, each of said uprights of each of said plurality of gondola displays having a plurality of vertically spaced vertical slots therein, the corresponding slots of different ones of said uprights being horizontally aligned for supporting a shelf, and said differing gondola displays being characterized by a different combination of spacing of said uprights, of the dimensions of said slots, of the shape of said slots, and of the spacing of said slots in said uprights, each of said gondola displays being further characterized by having at least one shelf supported from said at least two vertical uprights and cantilevered over said base from said at least two vertical uprights, which method comprises removing said one shelf from said at least two vertical uprights, mounting a supporting bracket on each upright of said one gondola display by engaging a rearwardly facing hook of each bracket with one of the corresponding slots of said uprights, and mounting said fixed size and configuration of replacement shelf on said brackets by engaging a hook of one of said brackets or said replacement shelf with a slotted opening in the other of said brackets or said replacement shelf.

2. The method of converting the shelf of any one of a plurality of differing gondola displays to a fixed size and configuration replacement shelf of a different type and wherein each of the gondola displays has a base and two horizontally spaced vertical uprights fixed to and extending upwardly from said base, each of said uprights of each of said plurality of gondola displays having a plurality of vertically spaced vertical slots therein, the corresponding slots of each of said uprights being horizontally aligned for supporting a shelf, each of said gondola displays having at least one shelf supported from said two vertical uprights and cantilevered over said base from said two vertical uprights, which method comprises, removing said at least one shelf from said two vertical uprights, mounting one of a pair of supporting brackets on each upright of said one gondola display by engaging a rearwardly facing hook of each bracket with one of the corresponding slots of said uprights, and mounting said fixed size and configuration replacement shelf on said bracket by engaging a hook of one of said brackets or said replacement shelf with a slotted opening in the other of said brackets or said replacement shelf.

3. The method of converting the shelf of a gondola display to a fixed size and configuration replacement shelf of a different type and wherein said gondola display has a base and two horizontally spaced vertical uprights fixed to and extending upwardly from said base, each of said uprights of said gondola display having a plurality of vertically spaced vertical slots therein, the corresponding slots of each of said uprights being horizontally aligned for supporting a shelf, each of said gondola displays having at least one shelf supported from said two vertical uprights and cantilevered over said base from said two vertical uprights, which method comprises removing said at least one shelf from said two vertical uprights, mounting one of a pair of supporting brackets on each upright of said one gondola display by engaging a rearwardly facing hook of each bracket with one of the corresponding slots of said uprights, and mounting said fixed size and configuration replacement shelf on said bracket by engaging a hook of one of said brackets or said replacement shelf with a slotted opening in the other of said brackets or said replacement shelf.

4. The method of converting the shelf of any one of a plurality of differing gondola displays to a fixed size and configuration replacement shelf of a different type and wherein each of the gondola displays has a base and at least two horizontally spaced vertical uprights fixed to and extending upwardly from said base, each of said uprights of each of said plurality of gondola displays having a plurality of vertically spaced vertical slots therein, the corresponding slots of different ones of said uprights being horizontally aligned for supporting a shelf, and said differing gondola displays being characterized by a different combination of spacing of said uprights, of the dimensions of said slots, of the shape of said slots, and of the spacing of said slots in said uprights, each of said gondola displays being further characterized by having at least one shelf supported from said at least two vertical uprights and cantilevered over said base from said at least two vertical uprights, which method comprises removing said at least one shelf from said at least two vertical uprights, mounting a supporting bracket on each upright of said one gondola display by engaging a rearwardly facing hook of each bracket with one of the corresponding slots of said uprights, and mounting said fixed size and configuration replacement shelf on said brackets by engaging a forwardly facing hook of each of said brackets with a slotted opening in said replacement shelf.

5. The method of claim 4 wherein each of said brackets are offset such that the rearwardly facing hook of each bracket is laterally displaced from the forwardly facing hook of the same bracket and which method further comprises reversing both of said brackets such that the brackets which were offset outwardly are offset inwardly or the brackets which were offset inwardly are offset outwardly so as to extend the range of horizontal spacing of said uprights which may be accommodated by said replacement shelf.

6. The method of converting the shelf of a gondola display to a fixed size and configuration replacement shelf of a different type and wherein said gondola display has a base and two horizontally spaced vertically uprights fixed to and extending upwardly from said base, each of said uprights of said gondola display having a plurality of vertically spaced vertical slots therein, the corresponding slots of each of said uprights being horizontally aligned for supporting a shelf, each of said gondola displays having at least one shelf supported from said two vertical uprights and cantilevered over said base from said two vertical uprights, which method comprises mounting one of a pair of supporting brackets on each upright of said one gondola display by engaging a rearwardly facing hook of each bracket with one of the corresponding slots of said uprights, and mounting said fixed size and configuration replacement shelf on said bracket by engaging a hook of one of said brackets or said replacement shelf with a slotted opening in the other of said brackets or said replacement shelf, said hook of said one of said brackets or said replacement shelf being laterally offset from the rearwardly facing hook of said brackets, such that by reversing the location of both of said brackets in said uprights, the range of horizontal spacing of said uprights which may be accommodated by said replacement shelf is extended.

7. The method of converting the shelf of any one of a plurality of differing gondola displays to a fixed size and configuration replacement shelf of a different type and wherein each of the gondola displays has a base and at least two horizontally spaced vertical uprights fixed to and extending upwardly from said base, each of said uprights of each of said plurality of gondola displays having a plurality of vertically spaced vertical slots therein, the corresponding slots of different ones of said uprights being horizontally aligned for supporting a shelf, and said differing gondola displays being characterized by a different combination of spacing of said uprights, of the dimensions of said slots, of the shape of said slots, and of the spacing of said slots in said uprights, each of said gondola displays being further characterized by having at least one shelf supported from said at least two vertical uprights and cantilevered over said base from said at least two vertical uprights, which method comprises mounting supporting brackets on each upright of said one gondola display by engaging a rearwardly facing hook of said bracket with one of the corresponding slots of said uprights, and mounting said fixed size and configuration replacement shelf on said bracket engaging a forwardly and upwardly facing hook of said bracket with one of a plurality of horizontally spaced and horizontally extended slotted openings in the rear of said replacement shelf, said forwardly and upwardly facing hooks having a thickness of less than one-third and width of said horizontally extended slotted openings of said replacement shelf with which the hooks are engageable so as to enable said hooks to be engageable with said horizontally extended slotted openings when said rearwardly and downwardly facing hooks of said brackets are engaged in slots of vertical uprights of said gondola displays having differing horizontal spacing of said slots in said uprights.

8. The method of converting the shelf of any one of a plurality of differing gondola displays to a fixed size and configuration replacement shelf of a different type and wherein each of the gondola displays has a base and at least two horizontally spaced vertical uprights fixed to and extending upwardly from said base, each of said uprights of each of said plurality of gondola displays having a plurality of vertically spaced vertical slots therein, the corresponding slots of different ones of said uprights being horizontally aligned for supporting a shelf, and each of said differing gondola displays being characterized by a different combination of spacing of said uprights, of the dimensions of said slots, of the shape of said slots, and of the spacing of said slots in said uprights, each of said gondola displays being further characterized by having at least one shelf supported from said at least two vertical uprights and cantilevered over said base from said at least two vertical uprights, which method comprises mounting supporting brackets on each upright of said one gondola display by engaging a first rearwardly facing hook of said bracket with one of the corresponding slots of said upright and by engaging a second rearwardly facing tab with a different one of the slots of said upright, said rearwardly facing tab having a vertical height substantially less than the vertical height of said rearwardly facing hook so as to enable said tab to fit within a plurality of differently spaced and differently sized vertical slots in said uprights of said differing gondola displays, and mounting said fixed size and configuration replacement shelf on said bracket by engaging a forwardly and upwardly facing hook of said bracket with one of a plurality of horizontally spaced and horizontally extended slotted openings in the rear of said replacement shelf, said forwardly and upwardly facing hooks having a thickness of less than one-third the width of said horizontally extended slotted openings of said replacement shelf with which the hooks are engageable so as to enable said hooks to be engageable with said horizontally extended slotted openings when said rearwardly and downwardly facing hooks of said brackets are engaged in slots of vertical uprights of said gondola displays having differing horizontal spacing of said slots in said uprights.

9. The method of converting the shelf of any one of a plurality of differing gondola displays to a fixed size and configuration replacement shelf of a different type and wherein each of the gondola displays has a base and at least two horizontally spaced vertical uprights fixed to and extending upwardly from said base, each of said uprights of each of said plurality of gondola displays having a plurality of vertically spaced vertical slots therein, the corresponding slots of different ones of said uprights being horizontally aligned for supporting a shelf, and said differing gondola displays being characterized by a different combination of spacing of said uprights, or of the dimensions of said slots, or of the shape of said slots, or of the spacing of said slots in said uprights, each of said gondola displays being further characterized by having at least one shelf supported from said at least two vertical uprights by structure formed integral with said one shelf, said one shelf being cantilevered over said base from said at least two vertical uprights, which method comprises removing said one shelf from said at least two vertical uprights by disengaging said integral structure of said one shelf from said uprights, mounting a loose supporting bracket on each upright of said one gondola display by engaging a rearwardly facing hook of each bracket with one of the corresponding slots of said uprights, and mounting said fixed size and configuration of replacement shelf on said loose brackets by engaging a hook of one of said brackets or said replacement shelf with a slotted opening in the other of said brackets or said replacement shelf.

* * * * *